United States Patent [19]

Davis

[11] Patent Number: 4,769,912

[45] Date of Patent: Sep. 13, 1988

[54] KNIFE WITH ACCELERATION SENSOR

[75] Inventor: Roger I. Davis, Manchester, England

[73] Assignee: Shirley Institute, Didsbury, England

[21] Appl. No.: 91,084

[22] Filed: Aug. 31, 1987

Related U.S. Application Data

[63] Continuation-in-part of Ser. No. 863,096, May 14, 1986, abandoned.

[51] Int. Cl.[4] ..... B26B 1/08

[52] U.S. Cl. ..... 30/162; 30/161

[58] Field of Search ..... 30/160–163

[56] References Cited

U.S. PATENT DOCUMENTS 3,999,290 12/1976 Wood ..... 30/2

FOREIGN PATENT DOCUMENTS 1272169 7/1968 Fed. Rep. of Germany .

2926809 1/1980 Fed. Rep. of Germany .

*Primary Examiner*—Douglas D. Watts

[57] ABSTRACT

There is provided a knife having a blade and handle. The knife incorporates acceleration detection means adapted to cause automatic occlusion of the blade upon detection of violent movement of the knife of at least 25 meters per second per second.

11 Claims, 2 Drawing Sheets

KNIFE WITH ACCELERATION SENSOR

RELATED APPLICATION

This is a continuation-in-part of my copending prior application Ser. No. 863,096 filed May 14, 1986 now abandoned. The disclosure in said copending Application is believed to be sufficient for one skilled in the art to practice this invention. The purpose of this continuation-in part Application is to provide quantitative reference for claimed subject matter.

BACKGROUND TO THE INVENTION

This invention concerns a knife of the kind (hereinafter termed "of the kind referred to") comprising a blade and handle.

In industry many accidents are caused by hand knives. The most serious injuries occur when the blade, forcibly applied to the work-piece, slips and strikes the limbs or body of the user. In textile mills such accidents happen most frequently where residual thread is being stripped from bobbins or where entangled threads are being cut away from rollers on spinning machines.

In such accidents the worker may be applying a force of such magnitude (about 150 N) that the knife, at the moment of slipping, can move with an acceleration substantially greater than 10 times that of gravity, or about 9.75 $ms^{-2}$, where "N" is Newtons and "$ms^{-2}$" is meters per second per second.

It is an object of the present invention to provide a knife of the kind referred to which prevents or at least reduces the incidence of the kinds of accident mentioned above.

SUMMARY OF THE INVENTION

According to the present invention there is provided a knife of the kind referred to incorporating acceleration detection means adapted to cause automatic retraction of the blade into the handle upon detection of violent movement of the knife at least with the cutting edge of the blade in a leading attitude. By "violent movement" is meant movement associated with accidental slippage of the knife.

BRIEF DESCRIPTION OF THE DRAWINGS

The invention will be further apparent from the following description, with reference to the figures of the accompanying drawing, which show, by way of example only, two forms of knife of the kind referred to and embodying the invention.

Of the drawings.

DETAILED DESCRIPTION OF THE PREFERRED EMBODIMENTS

Figure 1:
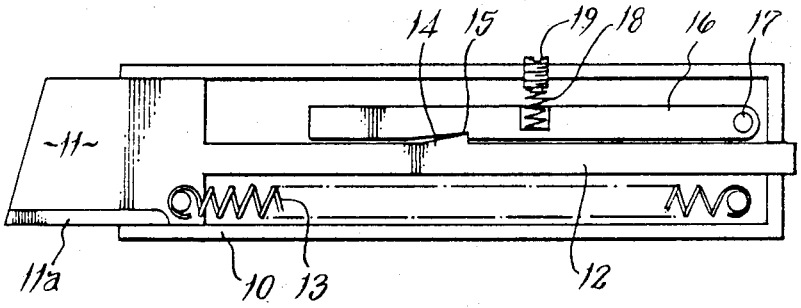
FIGS. 1 and 2 are longitudinal cross-sections through the first form of knife with the blade thereof in its extended and retracted positions respectively.
Figure 2:
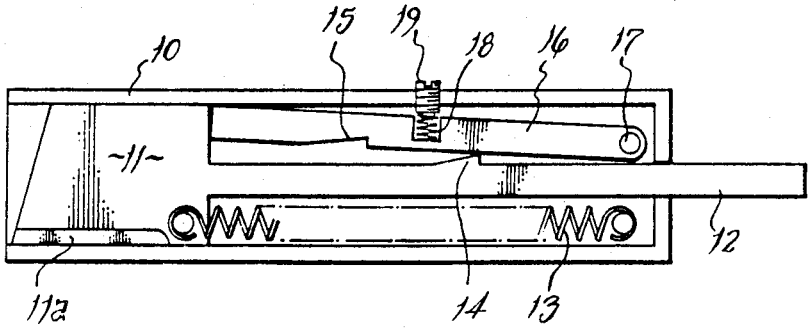

Referring first to FIGS. 1 and 2 it will be seen that the first form of knife comprises a handle 10 of hollow box-like construction and a blade 11 on the forward end of a tang 12. The blade 11 and tang 12 are slidable axially within the handle 10 to enable the blade 11 to be moved from an operative position wherein its cutting edge 11*a* extends outwardly from the forward end of the handle (FIG. 1) to an inoperative or safe position wherein the blade 11 is fully retracted into the handle 10 (FIG. 2).

A tension spring 13 has its opposite ends anchored to the blade 11 and the rear of the handle 10 respectively and acts to urge the blade 10 into its inoperative or safe position.

The blade 11 may be slid into its operative position by pushing on the end of the tang 12 which projects rearwardly from the handle 10 and there locked in position by engagement of a latch 14 projecting from the tang 12 with a detent 15 in a heavy arm 16 pivotally connected with the handle 10 at 17 and extending generally parallel with the tang 12.

In use, if the body of the knife accelerates violently in the plane of movement of the arm 16 with the cutting edge of the blade in a leading attitude, the arm, owing to its inertia, moves relative to the tang 12 thus releasing the latch and retracting the blade. Equally the latch may be released to retract and occlude the blade 11 for safe storage simply by a sharp rap on the handle 10 of the knife.

The sensitivity of the system may be engineered by appropriate geometry but day-to-day adjustments may be made by adjusting the force exerted on the arm 16 by a compression spring 18 by means of a grub screw 19.

Figure 3:
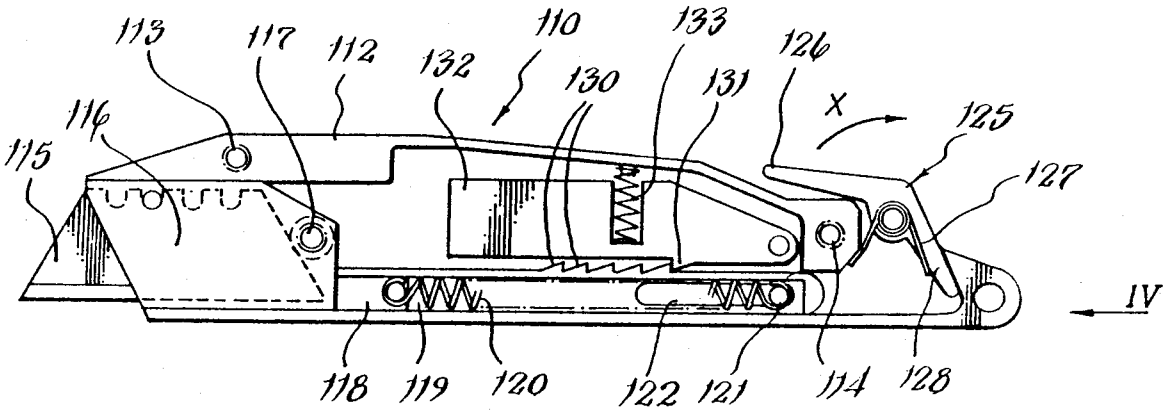
FIG. 3 is a longitudinal cross-section through the second form of knife with the blade thereof in an extended operative position.
Figure 4:
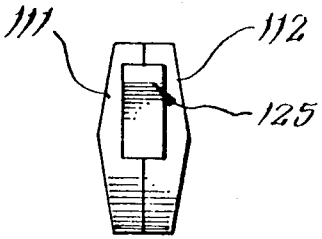
FIG. 4 is an end view of the knife seen in the direction of arrow IV on FIG. 3.

Referring now to FIGS. 3 and 4, it will be seen that the second form of knife comprises a handle 110 formed from two shell-like halves 111 and 112 which can be joined by screws at 113 and 114 on a longitudinal central plane of the handle 110 to form a box-like enclosure which houses the working parts of the knife.

The knife includes a blade 115, which is a replaceable item, and which is clamped between support plates 116 by means of a screw 117. To gain access to screw 117 for blade replacement purposes it is necessary to separate the handle halves 111 and 112.

One of the support plates 116 is connected to or integrally formed with a rearwardly projecting tang-like member 118 which has a longitudinally extending lateral recess 119 which houses a tension spring 120 whose forward end is anchored to the member 118 adjacent the plates 116 and whose rearward end is anchored to a transverse pin 121 extending between the halves 111 and 112 and through a longitudinally extending slot 122 in the member 118.

The assembly including member 118 is slidable between a forward position wherein the blade 115 protrudes operatively from the handle 110 and a rearward position wherein the blade 115 is retracted to lie within the body of the handle 110. The spring 120 acts to urge the assembly including member 118 into the rearward position.

A cranked lever 125 is pivotally mounted at the rear of the handle such that one of its arms 126 is accessible from without the handle for movement (in the direction of arrow X) against the action of a return torsion spring 127 to move the other of its arms 128 into engagement with an abutment surface at the rear end of member 118 to slide the assembly including member 118 forwardly to lock blade 115 protruding outwardly from handle 110 by a desired extent by engagement of one of a series of longitudinally spaced teeth 130 along the upper face of member 118 with a tooth 131 on the underside of a pivotally mounted weighted arm 132 mounted within the handle 110 above member 118. A spring 133 urges arm 132 towards member 118 and its strength is selected to ensure retraction of the assembly including member 118 and hence blade 115 when the handle 110 of the knife accelerates in the plane of movement of arm 132 with the cutting edge of the blade in a leading attitude at or above a predetermined rate because of relative movement between arm 132 and member 118 to disengage the tooth 131 from the tooth 130. Again, the blade 115 may be moved to its retracted position by delivery of a sharp rap to the handle 110.

The blade of a knife embodying the invention retracts only if a violent acceleration, invariably associated with loss of control by the user is detected. The meaning of "violent acceleration" is brought out in the following discussion of the dynamics of cutting.

There is no reliable way to determine the effort exerted during cutting other than by experiment so the following test was devised.

A small platform balance was firmly fixed to the top of a bench with the platform 0.83 m from the floor. A sheet of plywood was fixed to the platform and a piece of cardboard size A5, 1.48 mm thick was taped to the plywood. Four clear lines about 25 mm apart and at right angles to the front edge of the bench, were ruled on the cardboard and subjects were asked to cut the card with a commonly-used knife three times, once between different pairs of lines. A note was made of the highest force indicated during each cut, this being recorded with details of th subject (height, weight and sex).

An estimate of the mass of the forearm of each participant was made using a top-pan balance. Each was asked to place his/her hand on the pan of the balance and a reading was taken with the forearm relaxed and horizontal and with the upper arm vertical. The mass of the arm was taken as twice the reading from the balance and 150 g was added to represent a knife. All the data obtained is presented in Table A.

TABLE A

RESTRAINED CUTTING DYNAMICS

| Subject | Sex | Mass (Kg) | Height (m) | Arm Mass (Kg) | Cutting Force (N) (1) | (2) | (3) | mean | Acceleration ($ms^{-2}$) | Stopping Distance mm |
|---|---|---|---|---|---|---|---|---|---|---|
| A | M | 57 | 1.80 | 1.51 | 30 | 30 | 30 | 30 | 59 | 150 |
| B | M | 58 | 1.70 | 1.75 | 30 | 30 | 30 | 30 | 51 | 130 |
| C | M | 68 | 1.70 | 1.97 | 30 | 30 | 30 | 30 | 45 | 110 |
| D | M | 67 | 1.65 | 1.97 | 30 | 30 | 26 | 29 | 44 | 110 |
| E | F | 52 | 1.55 | 1.05 | 22 | 26 | 18 | 22 | 62 | 155 |
| F | F | 57 | 1.55 | 1.11 | 18 | 18 | 22 | 19 | 51 | 130 |
| G | M | 79 | 1.68 | 1.75 | 14 | 14 | 18 | 15 | 26 | 65 |
| H | F | 47 | 1.55 | 1.29 | 26 | 26 | 30 | 27 | 63 | 160 |
| I | M | 70 | 1.50 | 1.63 | 26 | 26 | 30 | 27 | 50 | 125 |
| J | F | 70 | 1.68 | 2.65 | 30 | 30 | 26 | 29 | 30 | 75 |
| K | M | 73 | 1.78 | 2.19 | 30 | 30 | 36 | 32 | 44 | 110 |
| L | M | 80 | 1.73 | 1.51 | 46 | 46 | 52 | 48 | 95 | 240 |
| M | F | 64 | 1.63 | 1.05 | 30 | 30 | 30 | 30 | 85 | 210 |
| N | F | 60 | 1.63 | 1.97 | 22 | 26 | 22 | 23 | 35 | 90 |
| O | F | 58 | 1.65 | 1.05 | 14 | 18 | 18 | 17 | 48 | 120 |

It is at once apparent that about two-thirds of the subjects applied a normal force, while cutting, of around 30 N and surprisingly this force was found to be just sufficient to sever the card. Only one subject applied a force in excess of that required and those who applied less may have done so in the belief that the task was impossible.

Because the human arm is articulated and of irregular cross section its motion is difficult to analyze. However, the slipping knife problem, with some justification from observation, may be reduced to a study of the motion of the forearm. The forearm is approximately modelled by a rod pivoted at one end, the elbow, while slipping from the workpiece is represented by the sudden application of a force at the free end of the rod and of magnitude equal to that applied normally to the surface during cutting. Thus, the acceleration of a knife in the hand, after slippage, is estimated by the equation $$f=3F/M_a$$

where:

F (N) is the applied force $M_a$ (Kg) is the mass of the forearm.

Neglecting gravity, values of acceleration obtained from this equation are included in Table A.

From these results it may be concluded that if a knife slips during cutting, acceleration ranging from 30 to 95 $ms^{-2}$ may occur.

Furthermore, discounting data where inappropriate cutting forces were applied, a typical acceleration associated with slipping during controlled cutting of tough material would be 50 $ms^{-2}$.

When a knife slips the extensor muscles of the arm, particularly the triceps, suddenly contract. This unexpected muscular activity generates a stream of nervous impulses which are processed by reflex arcs to bring about relaxation of the extensor muscles and tensing of the retractor muscles, mainly the biceps, with the aim of restoring control as quickly as possible. Such reflex responses, although the most speedy available in the human body, require a finite time, $t_s$, to act. At best the delay is of the order of 50 ms in which time the hand grasping the knife continues to accelerate under the applied cutting force. If it is assumed that the biceps and triceps are of equal power then on receipt of nerve signals to "reverse" the forearm will decelerate for a further period $t_s$ before coming to rest.

The distance travelled during equal periods of acceleration and deceleration, a, is:

$$y_s=a\,t_s^2 \qquad (1)$$

Estimated individual stopping distances from (1) taking $t_s$ as 50 ms, appear in Table A and range from 65 to 240 mm. Taking the mean of those results, considered to represent a genuine cutting effort, gives a typical stopping distance of 130 mm after slipping when cutting in a restrained manner.

In the foregoing discussion, cutting action of a regulated and precise kind has been considered. However, trimming knives are also used for rough work (for example opening parcels) where a vigorous slashing action is employed. For such activity it is difficult even to guess at the levels of acceleration occurring both during a normal slash cut and on slipping. Similarly the way in which the human nervous system detects and counters loss of control when the arm is already in rapid motion is not easy to contemplate.

In order to learn something of the mechanics of slash cutting this activity was simulated in the laboratory. A subject stood at one end of a bench and while pressing sufficiently to score a piece of plywood which had been fixed to the bench, drew a knife swiftly across the surface deliberately slipping it off the edge. Now it is clear that the slipping in these circumstances was expected by the subject who therefore may have moderated the effort applied and hence the resulting accelerations. However, some element of surprise was introduced by conducting the whole procedure in total darkness.

The motion during slash cutting was recorded by taping a small lamp, powered by a stroboscope, to the hand of the subject. A photograph was taken at each pass, the shutter of the camera being opened long enough to encompass the total sweep of the knife. This resulted in a series of bright dots on the film representing the position of the hand at equally-spaced intervals of time. Three flashing rates were used, 1000, 2000 and 4000 per minute.

An alternative recording method was also used where the action was illuminated with a powerful stroboscope and photographed with an open shutter to give a series of superimposed but displaced images. Knowing the scale of the print, it is possible, by using a travelling microscope, to measure the distance between points of light or images and compile a complete history of the motion during cutting. Furthermore both velocity and acceleration can be estimated to adequate accuracy at any instant by the method of differences. This was done and the results are given in Table B.

TABLE B

SLASH CUTTING KINEMATICS

| Time (ms) | Movement (mm) | Velocity ($ms^{-1}$) | Acceleration ($ms^{-2}$) |
|---|---|---|---|
| 0 | — | — | — |
| 15 | 7.9 | 0.53 | — |
| 30 | 10.7 | 0.71 | 12.0 |
| 45 | 12.3 | 0.82 | 7.3 |
| 60 | 16.1 | 1.01 | 12.6 |
| 75 | 18.5 | 1.23 | 14.7 |
| 90 | 20.8 | 1.39 | 6.7 |
| 105 | 23.6 | 1.57 | 12.0 |
| 120 | 26.4 | 1.76 | 12.7 |
| 135 | 28.1 | 1.87 | 7.3 |
| 150 | 28.9 | 1.93 | 4.0 |
| 165 | 26.9 | 1.89 | 2.6 |
| 180 | 25.1 | 1.67 | −14.7 |
| 195 | 17.2 | 1.14 | −35.3 |
| 210 | 34.4 | 2.29 | 76.7 |
| 225 | 60.2 | 4.01 | 114.7 |
| 240 | 56.8 | 3.79 | −14.7 |
| 255 | 54.3 | 3.62 | −11.3 |
| 270 | 51.3 | 3.42 | −13.3 |
| 285 | 48.6 | 3.24 | −12.0 |
| 300 | 45.1 | 3.01 | −15.3 |
| 315 | 40.3 | 2.69 | −21.3 |
| 330 | 33.7 | 2.25 | −29.3 |
| 345 | 25.5 | 1.70 | −36.7 |
| 360 | 20.0 | 1.33 | −24.7 |
| 375 | 14.9 | 0.99 | −22.7 |

From this record, it is clear that the acceleration, 115 $ms^{-2}$, after slipping is a little more than twice that expected during restrained cutting. Also the stopping distance of around 45O mm is greatly extended.

It is of particular interest that the acceleration during the cutting phase of up to 15 $ms^{-2}$ is about half the lowest acceleration expected when slipping during restrained cutting.

The reaction to slipping is interesting in that there is no sign of corrective activity for about 30–45 ms, after which a steady but modest deceleration is evident. This is followed at about 105 ms after slipping by a sustained and more determined retardation to rest. This is in keeping with the current view of an initial reflexive response followed by a later back-up directed by the cortex.

When a knife slips during use and deviates from its expected course, injury can occur only if some part of the user's body is within range. That is, the minimum working distance must be less than the stopping distance. Accordingly a discussion of knife safety requires some knowledge of typical working distances during the various common working attitudes.

One of three body positions is generally adopted by a worker cutting with a trimming knife. These are:

(a) standing,
(b) sitting,
(c) kneeling. Furthermore, from these positions a variety of cutting motions may be executed. The preferred and most commonly used cutting strokes against independently supported workpieces are:
(1) vertical and down,
(2) horizontal and across the body,
(3) horizontal and towards the body.

In order to observe the various combinations of the above postures and strokes, several subjects were given wooden pegs similar in size to trimming knives and were asked to make cutting strokes between two clear lines 25 mm apart; vertical on a vertical wall, normal to the front edge of a horizontal bench and on the floor. Cutting across the body was not simulated as in the main this does not constitute any danger to the user of a knife. The subjects freely positioned themselves relative to the target lines and as they made cutting strokes the distances of nearest approach, to parts of the body which were obviously in danger, were estimated. These observations are presented in Table C the working distances having been judged to the nearest 50 mm. Clearly results so obtained are very approximate but nevertheless suggest working distances as close as 25 mm in some instances.

TABLE C

WORKING DISTANCES

| Posture | Surface | Body | Distance mm |
|---|---|---|---|
| standing | wall | hand | 150 |
| | | thigh | 400 |
| standing | bench | hand | 150 |
| | | thigh | 200 |
| sitting | wall | hand | 200 |
| | | knee | 50 |
| sitting | bench | hand | 100 |
| | | thigh | 150 |
| kneeling | wall | hand | 150 |
| | | knee | 100 |
| kneeling | floor | hand | 200 |
| | | knee | 50 |
| | | foot | 50 |

More dangerous activity occurs in instances where the workpiece is not self-supporting; for example clearing remnants of thread from hand-held textile bobbins. Similarly there is great danger when cutting flat objects using a straight edge, supported by the hand, to guide the blade. In these cases the working distance from the fingers may be less than 10 mm.

In the preceding discussion, important variables relevant to the design of a safety knife have been defined and quantified as follows:

(1) Orthogonal force during restrained cutting:
15–48 N, typically 30 N.

(2) Acceleration when slipping during restrained cutting:
30–95 $ms^{-2}$, typically 50 $ms^{-2}$.

(3) Stopping distance after slipping during restrained cutting:
65–240 mm typically 130 mm.

(4) Working acceleration during slash cutting:
15 $ms^{-2}$.

(5) Maximum acceleration on slipping during slash cutting:
115 $ms^{-2}$.

(6) Stopping distance after slipping during slash cutting:
500 mm.

(7) Working distance when cutting self-supporting objects:
50–400 mm, typically 200 mm.

(8) Working distance when cutting to a straight edge:
10 mm or less.

It is also apparent from the foregoing discussion that for present purposes, "violent acceleration" can be deemed to be acceleration of at least about 20 $ms^{-2}$, or at least 25 $ms^{-2}$.

It will be appreciated that it is not intended to limit the invention to the above example only, many variations, such as might readily occur to one skilled in the art, being possible, without departing from the scope thereof as defined by the appended claims.

For example, a longitudinal thumb slide protruding from the underside of the knife handle may be provided for movement of the blade-carrying assembly to its forward or operative position.

Other means for detecting acceleration than that described may be used such as electronic transducer means, but a simple mechanical system is preferred on the grounds of reliability and cost.

I claim:

1. A knife having a blade and a handle and comprising acceleration detecting means, and blade occluding means operable in response to said acceleration detecting means to cause automatic occlusion of the blade upon detection of an acceleration of the knife of at least 25 meters per second per second.

2. A knife having a blade and a handle and comprising acceleration detecting means, and blade retracting means operable in response to said acceleration detecting means to cause automatic retraction of the blade into the handle upon detection of an acceleration of the knife of at least 25 $ms^{-2}$.

3. The knife according to claim 2 wherein the blade is arranged for sliding movement between a forward operative position wherein it extends outwardly from the handle and a rearward retracted position wherein the blade is occluded wholly within the handle, the blade being carried by a rearwardly extending tang-like member extending longitudinally of the handle.

4. The knife according to claim 3 wherein spring means are provided between said tang-like member and the handle and serve to urge the blade to its rearward retracted position.

5. The knife according to claim 4 wherein a pivoted lever is located within the handle to extend generally parallel with said tang-like member and has a tooth formation on its face adjacent said tang-like member and adapted to engage a cooperating tooth formation on the tang-like member to latch same to hold the blade in its forward operative position against the action of said spring means, the arrangement being such that said violent movement causes relative movement between the lever and the tang-like member to break the engagement between the cooperating teeth.

6. A knife having a blade and a handle and comprising acceleration detecting means and blade retracting means adapted to cause automatic retraction of the blade into the handle upon detection of violent movement of the knife at least with the cutting edge of the blade in a leading attitude, the blade arranged for sliding movement between a forward operative position wherein it extends outwardly from the handle and a rearward retracted position wherein the blade is occluded wholly within the handle, the blade being carried by a rearwardly extending tang-like member extending longitudinally of the handle, spring means provided between said tang-like member and the handle and serving to urge the blade to its rearward retracted position, a pivoted lever locked within the handle to extend generally parallel with said tang-like member and having a tooth formation of its face adjacent said tang-like member adapted to engage a cooperating tooth formation on the tang-like member to latch same to hold the blade in its forward operative position against the action of said spring means whereby said violent movement causes relative movement between the lever and the tang-like member to break the engagement between the cooperating teeth, a plurality of longitudinally spaced teeth on the tang-like member enabling the blade to be latched with a desired extent of protrusion.

7. The knife according to claim 5 wherein said lever is urged towards the tang-like member by resilient means which are adjustable.

8. The knife according to claim 4 wherein said spring means comprise a tension spring connected between said tang-like member adjacent the forward end thereof and a rearward part of the handle.

9. The knife according to claim 3 including manually operable means for sliding the tang-like member and with it the blade from its rearward retracted position to its forward operative position.

10. A knife having a blade and a handle and comprising acceleration detecting means and blade retracting means adapted to cause automatic retraction of the blade into the handle upon detection of violent movement of the knife at least with the cutting edge of the blade in a leading attitude, the blade arranged for sliding movement between a forward operative position wherein it extends outwardly from the handle and a rearward retracted position wherein the blade is occluded wholly within the handle, the blade being carried by a rearwardly extending tang-like member extending longitudinally of the handle, manually operable means for sliding the tang-like member and with it the blade from its rearward retracted position to its forward operative position, said manually operable means comprising a cranked lever which is pivoted to bring one of its arms to bear against an end of the tang-like member to push it forwardly.

11. The knife according to claim 10 wherein the cranked lever is operated against the action of return spring means.

* * * * *